US005192052A

United States Patent [19]

Abarotin

[11] Patent Number: 5,192,052

[45] Date of Patent: Mar. 9, 1993

[54] POST EXTRACTING FIXTURE

[76] Inventor: Eugene V. Abarotin, 3538 McWilliams Rd., Murrysville, Pa. 15668

[21] Appl. No.: 853,999

[22] Filed: Mar. 19, 1992

[51] Int. Cl.[5] ..... E21B 19/00

[52] U.S. Cl. ..... 254/30; 254/133 R; 254/131; 269/219

[58] Field of Search ..... 259/30, 29 R, 131, 131.5, 259/133 R, 132; 269/219, 246, 250, 54

[56] References Cited

U.S. PATENT DOCUMENTS 2,543,140 2/1951 Vickerman ..... 269/219

4,459,729 7/1984 Volkmann ..... 254/30

*Primary Examiner*—Bruce M. Kisliuk

*Assistant Examiner*—Eileen P. Morgan

[57] ABSTRACT

A device for removing a post from the ground. The device includes two rigid plate members for engaging opposed sides of the post. Two fasteners extend through one of the plate members for threadably engaging the other plate members so that the two plate members can tightly engage the post. When a device capable of exerting a lifting force engages at least one of the plate members, and is operated to exert such a force against the plate member, the post is removed from the ground.

4 Claims, 3 Drawing Sheets

POST EXTRACTING FIXTURE

BACKGROUND ON THE INVENTION

Figure 1A:
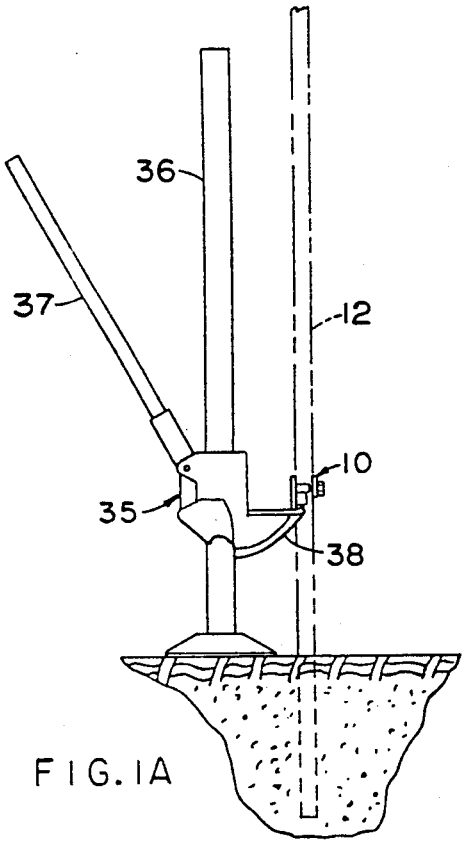

The present invention relates generally to the extraction of slender posts from the ground and particularly to a fixture for engaging the post so that an upwardly directed force against the fixture easily extracts the post from the ground.

The highway departments of the respective states of the United States, as well as municipalities and other governmental units within the states, and the federal government, employ thousands and even millions of posts for supporting signs of one form or another. Signs are changed for whatever reason and posts removed from the ground. Presently, highway departments employ large equipment, such as power shovels, to remove the posts from the ground. A shovel is connected to a chain wrapped around the post and the shovel lifted to remove the post. Such equipment must be driven or hauled to the site and operated often by well paid, experienced personnel. As such, post removal is costly. The operation, in addition, may be difficult, if the ground is soft and the equipment moved onto private property. Further, space is not always available for the use of such equipment.

There are, in the post extracting art, devices that engage posts in a manner that uses integral lugs on the posts in the extracting process. This is in particular reference to the devices shown in U.S. Pat. Nos. 4,040,601 and 4,422,621 to Boardman and Eckern respectively. In Eckern, for example, a cross-bar device 21 engages integral lugs 12 on a T-shaped (in cross section) fence post for supporting strands of wire used on ranches and farms. Without the integral lugs, the devices of Eckern and Boardman do not have the ability to engage the posts for lifting purposes.

BRIEF SUMMARY OF THE INVENTION

The present invention is directed to a fixture that will tightly engage the shank of a vertical post and extract the same from the ground when a lifting force is directed against the fixture. The fixture comprises two plates clamped to the post, the inward face of each plate engaging an opposite face or surface of the post. The plates are clamped to the post by two threaded fasteners. The outwardly directed tongue of a bumper type jack can be disposed underneath one of the plates and the jack operated to extract the post vertically from the ground. Other vertical force directed means, of course, can be used in place of such a jack.

If the post has a trapezoidal shape (in cross section), one of the plates can be provided with an integral similarly shaped boss for seating in the recess of the trapezoidal shape. In a similar manner, if the post is provided with an opening or a series of openings, the trapezoidal member can be provided with a forwardly extending pin to enter the opening and thereby provide further means of engaging the post when the bracket is lifted in an upward direction.

Such a bracket and jack can be carried to the site of a post to be extracted by a single workman. Similarly, one workman can extract the post using the jack. No motorized, heavy equipment is needed, with no concern for stable ground and earth conditions to support the weight of such vehicles. In addition, costs are minimal, as the bracket is inexpensive to make and, suitable jacks are commercially available at reasonable cost.

THE DRAWINGS

Figure 1B:
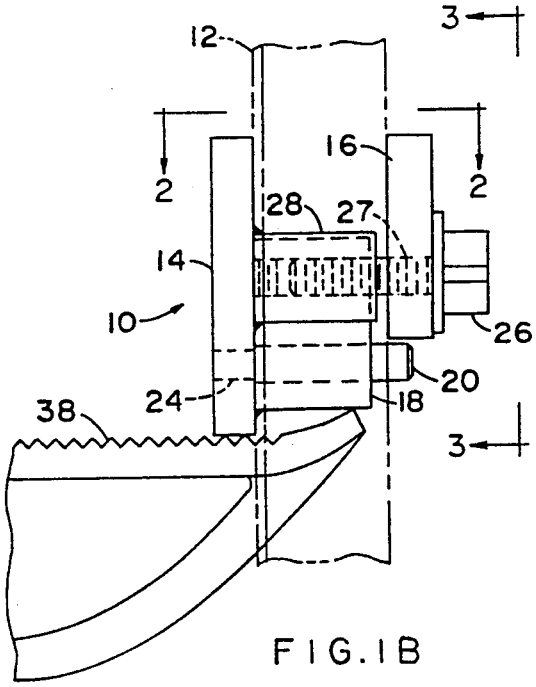
Figure 2:
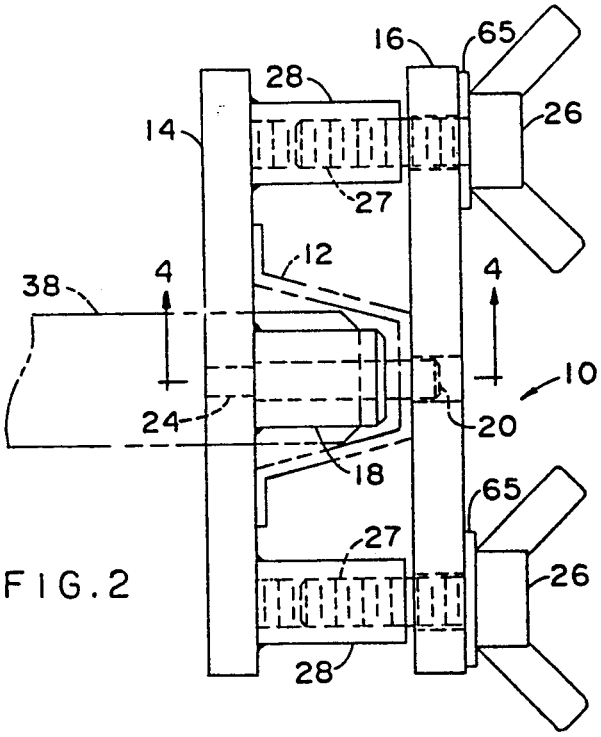
Figure 3:
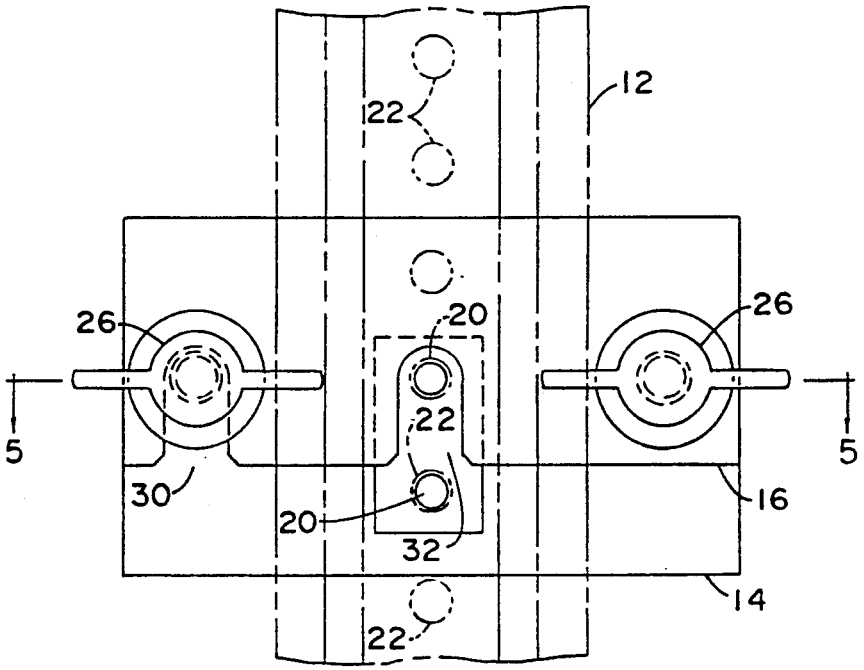
Figure 4:
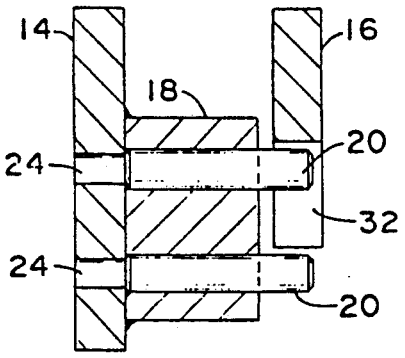
Figure 5:
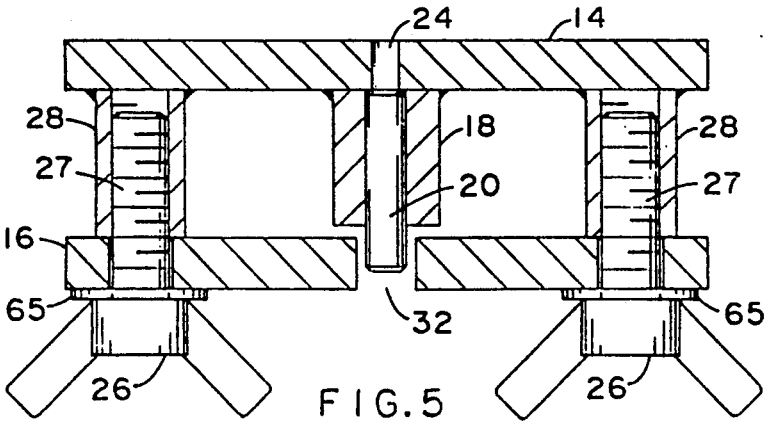
Figure 6:
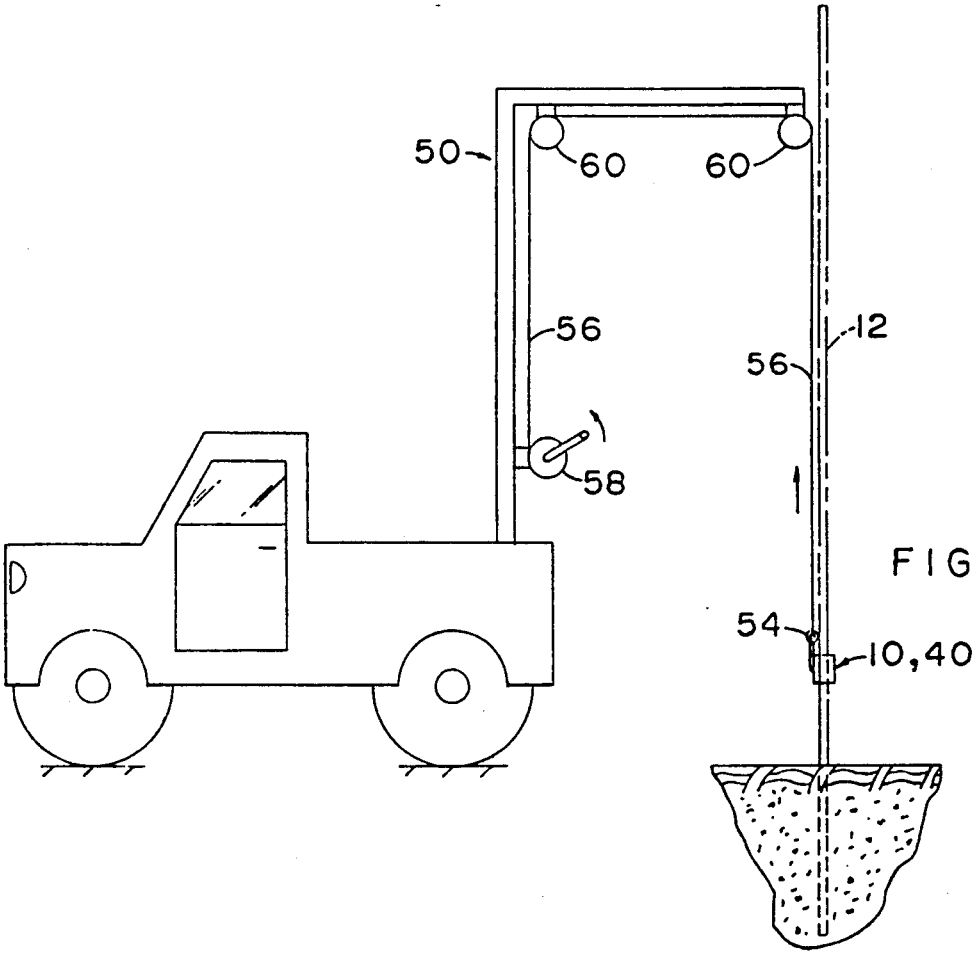
Figure 7:
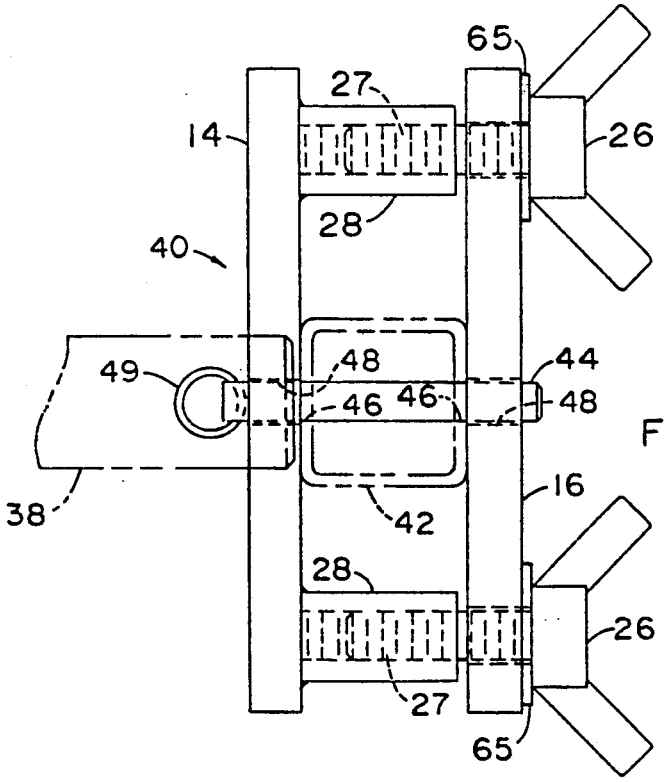

The invention, along with its objectives and advantages, will best be understood from consideration of the following detailed description and the accompanying drawings in which:

FIGS. 1A and 1B show the fixture of the invention attached to a vertical post (only partially shown in phantom) with a jack means engaging the fixture for the purpose of removing the post from the ground, FIG. 2 is a plan view of the fixture and post as taken along lines 2—2 of FIG. 1B, FIG. 3 is a front elevation view of the fixture and post taken along lines 3—3 of FIG. 1B, FIG. 4 is a sectional view of the fixture taken along lines 4—4 in FIG. 2, the section exposing two pins in elevation disposed to extend into respective holes provided in the post, FIG. 5 is a sectional view of the fixture taken along lines 5—5 in FIG. 3, FIG. 6 shows a second means engaging the fixture to remove a post from the ground, and FIG. 7 is a plan view of a second fixture of the invention, the fixture being attached to a rectangular or square shaped post.

PREFERRED EMBODIMENTS

Referring now to FIG. 2 of the drawings, a fixture 10 is shown attached to a slender trapezoidal shaped post 12 (in phantom), the lower end of which is located in the ground (FIG. 1A). The fixture includes a rigid rear flat plate 14, a rigid front flat plate 16, and a boss or block member 18 for seating in the trapezoid of the post. As shown in FIGS. 3 and 4, the boss is an integral part of rear plate 14 and can be integrally formed with the plate or attached thereto by any suitable means such as by welding. In FIGS. 1B, 2, 4 and 5, the boss is shown welded to the plate.

As shown in FIG. 4, boss 18 supports two pins 20 that extend through openings 22 (FIG. 3) provided in the post, when the rigid plates are properly attached to the post. Pins 20 are mounted in boss 18 in front of respective openings 24 (FIG. 1B, 2, 4 and 5) provided in rear plate 14. Openings 24 are "knock-out" openings for removing the pins if they break or otherwise become dysfunctional. In this manner new pins can be inserted into the boss in repairing the fixture.

Plates 14 and 16 are shown secured together and to post 12 by appropriate fasteners, such as thumb screws 26. The thumb screws have threaded shanks 27. The shanks are shown threaded into internally tapped spacers 28, as best seen in FIGS. 2 and 5. Like that of boss 18, spacers 28 are shown as an integral part of rear plate 14 and extend in a forward direction toward plate 16. Similarly, the lengths of spacers 28 and boss 18 are less than that of the hollow depth of post 12 so that they allow plates 14 and 16 to fully and firmly engage the rear and front surfaces of post 12 when thumb screws 26 are threaded into the spacers. This is best seen in FIG. 2. Hence, as further seen in FIG. 2, the distal ends of the spacers do not engage the rear surface of plate 16, though the plates fully engage post 12. Similarly, the forward end of boss 18 does not reach the inner surface of the trapezoid of the post, as again shown in FIG. 2.

In viewing plates 14 and 16 in side elevation in FIG. 1B and in front elevation in FIG. 3, it will be noted that the front plate 16 is narrower than rear plate 14. What is needed is a dimension sufficient for the front plate to be held in place by thumb screws 26. In addition, the front plate can be "captured" by one thumb screw 26 (in FIG. 3 the screw on the right). The other screw (on the left in FIG. 3), when loosened, permits the front plate to rotate about the shank of the screw on the right. This requires an "open" slot 30 in the front plate, as seen in FIG. 3, to allow rotation of the front plate to and from the shank of the screw on the left. The purpose of such an arrangement permits a workman to simply rotate the front plate from the screw in slot 30 and away from the boss and pins 20 when preparing to attach the fixture to a post. With the front plate 16 rotated to an "out-of-the-way" position, the workman inserts boss 18 into the rear of the post trapezoid and the pins 20 into two respective holes 22 provided in the post. The fixture is now ready to have the front plate returned (rotated) to locate slot 30 about the shank of the screw on the left, in FIG. 3. The wings of both screws are now manually rotated to thread the screw into spacers 28 to tighten the plates on and to the post.

Front plate 16 is provided with an additional slot 32 (FIGS. 3, 4 and 5) to clear the pins 20, since the pins extend through the inner wall of the post trapezoid and into the plane of the front plate. This is best seen in FIGS. 1B, 2, and 5 of the drawings.

With Fixture 10 firmly secured to post 12 (in the manner described above), the post is extracted from the ground by applying a lifting force to the fixture. This is effected in FIGS. 1A and 1B by a bumper type jack 35, vertically supported on the ground by a bar 36. A nose portion 38 of the jack can be located beneath and in engagement with the lower edge of rear plate 14 and/or boss 18, and the jack operated manually by movement of its handle 37. The nose of the jack thereby rises on supporting bar 36 to remove the post from the ground.

A jack that has been found highly effective in extracting posts is made by the HI-LIFT Company, P.O. Box 228, Bloomfield, Ind. 47424. HI-LIFT is a registered trademark of this company.

The fixtures of the invention, including that of FIG. 7, as discussed in detail below, are made of rugged material so as to withstand the lifting forces applied to them, yet are sufficiently small in size and light in weight so that one workman can easily carry the fixture to the location and site of a post to be extracted, and to easily and quickly secure the fixture to the post. Similarly, the fixture is easily adjusted on the post, and is adjustable to fit different size and types of metal, wood and fiberglass posts by simply loosening thumb screws 26. Further, the fixture is quickly removed from the extracted post, by loosening thumb screws 26 and rotating front plate 16 from the front of the post, which then permits removal of the rear plate, including boss 18 and spacers 28, from the rear of the post. No heavy equipment and related operating personnel are needed. Only a jack and a workman are needed, and other means capable of exerting a sufficient lifting force on the fixture can be used. One such other means is shown in FIG. 6 of the drawings and is discussed below.

Jack 35 is also manually transportable to the post site and quickly erected to engage fixture 10.

A suitable material for the components of the fixtures is medium strength steel, though other materials of corresponding strength can be used. Since the basic fixture comprises two simple flat plates, it is inexpensive to manufacture. Similarly, the center boss 18 and spacers can be made from basic metal stock at low cost and welded to the rear plate or fabricated as a steel casting with minimal effort and expense.

FIG. 7 of the drawings shows a second embodiment 40 of the invention, an embodiment suitable for engaging and extracting a post 42 having a rectangular or square configuration in cross section. This embodiment is a fixture similar to that of 10 except that center boss 18 is not needed. Hence, plate, thumb screw and spacer components of fixture 40 bear the same numeral designations as those of fixture 10 in the earlier figures. A pin 44 is shown, if needed, in the embodiment of FIG. 7. Such a pin requires aligned holes 46 in front and rear walls of post 42 and aligned holes 48 in the plates of the fixture when the front plate is rotated and secured in place on the post. Pin 44 can be of the type that is provided with a pull ring 49 for quick removal of the pin from the plates of the fixture and from the post after the post is extracted.

With the plates of fixture 40 exerting a sufficient force on post 42, pin 44 is not needed to extract the post from the ground. This is also true for the pins 20 of fixture 10, i.e., pins 20 and 44 are used when additional post engaging means are needed to lift the post.

FIG. 6 of the drawings shows a gantry means 50 for extracting a post. The gantry is shown located on the rear bed of a truck and can be operated manually or by a winch. Fixture 10 or 40 is provided with a ring 54 so that a hook (not shown) can be inserted into the ring and lifted by a cable or chain 56 connected to the hook. The cable or chain is wrapped around rotable means 58 by pulling the cable or chain over supporting pulleys 60 located on gantry 50. Means 58 can be a manually operated drum, if it is provided with sufficient mechanical advantage, or 58 can be a winch.

Washers 65 scan be used between the heads of thumb screws and the forward surface of the front plate, if desired, and the washers can be separate from the bolt heads or integrally formed therewith.

What is claimed is:

1. A device for removing a post from the ground, comprising:

a bracket for engaging opposed faces of the post, said bracket comprising a first rigid plate member having spaced apart internally threaded spacers capable of straddling the post when the plate member is placed thereagainst, a second rigid plate member having openings that straddle the post when the two plate members are aligned and disposed together in generally parallel planes on the post, threaded fasteners sized to be received by the openings in the second plate member and the internally threaded spacers of the first plate member, said fasteners and internally threaded spacers being effective to tightly secure the plate members on the post, the length of the spacers being somewhat less than the thickness of the post such that the two plate members tightly grip the post when the fasterners are suitably threaded into the spacers, and the plate member provided with said spacers having a center member sized to enter and seat in a recess of the post, said bracket being effective to extract the post from the ground when an upwardly directed force is applied to at least one of the plate members.

2. The device of claim 1 in which the center member has at least one pin extending therefrom for entering an opening in the post when the center member is seated in the recess of the post.

3. The device of claim 1 in which the plate with the center member is cast unit.

4. The device of claim 1 in which one of the openings in the second plate member secures said second member to the other plate member when one of the fasteners is inserted through said one opening and threaded into one of the spacers, while the other opening in said second plate member is an open-ended slot that permits escape of the second plate member from the other fastener and rotation of the second plate member relative to the first plate member about the one fastener.

* * * * *